United States Patent [19]

Thompson

[11] 4,357,722

[45] Nov. 9, 1982

[54] BED WITH ADJUSTABLY TENSIONABLE PATIENT SUPPORTING NET

[75] Inventor: Martin S. Thompson, Bickley, England

[73] Assignee: Egerton Hospital Equipment Limited, Bromley, England

[21] Appl. No.: 136,254

[22] Filed: Apr. 1, 1980

[30] Foreign Application Priority Data

Apr. 5, 1979 [GB] United Kingdom ..... 7912018

[51] Int. Cl.[3] ..... A61G 7/10; A61G 7/06

[52] U.S. Cl. ..... 5/62; 5/65; 5/61

[58] Field of Search ..... 5/61, 62, 66, 65, 81 R, 5/82, 90, 187, 186 R, 220

[56] References Cited

U.S. PATENT DOCUMENTS

| | | | |
|---|---|---|---|
| 1,699,026 | 1/1929 | Schumacher et al. | 5/220 |
| 3,748,666 | 7/1973 | Seng | 5/61 |
| 3,875,598 | 4/1975 | Foster et al. | 5/61 |
| 3,924,281 | 12/1975 | Gibbs | 5/61 |
| 4,084,274 | 4/1978 | Willis et al. | 5/61 |

*Primary Examiner*—Alexander Grosz

*Attorney, Agent, or Firm*—Fleit & Jacobson

[57] ABSTRACT

A bed in which a rockable frame comprises two longitudinally extending members over which is tensioned an open mesh net for supporting a patient. A plurality of adjusting means are provided for adjusting the tension of the net at various spaced positions along the length of the bed to accommodate the net to the shape of a particular patient being supported. Preferably a back and head rest also comprises a net to support the patient and padded sides are provided for pivotal movement between a position extending to retain a patient on the bed and a downwardly extending out-of-the way position. The various tension adjusting means preferably engage a flexible member threaded into the longitudinal side edges of the net for spreading the transmission of the tensioning load to the net.

19 Claims, 4 Drawing Figures

BED WITH ADJUSTABLY TENSIONABLE PATIENT SUPPORTING NET

DESCRIPTION

This invention relates to an improved bed and more especially to an improved bed to facilitate so moving a patient as to minimise the onset of bed sores.

The background of the art can be represented by the disclosures of the specifications of British Pat. Nos. 1,447,163; 1,369,861; 1,350,915; 1,260,813; 1,257,927; 514,525; 331,416; 264,698 and 262,564 and U.S. Pat. No. 4,109,329.

People who have to stay in bed for a prolonged period, whether in hosiptal or at home, frequently suffer from bed sores resulting from lying in the same position for a long time. The problem is particularly acute where the patient is unconscious or partly paralysed making it difficult for him to move himself. The normal procedure in hospital is for the nursing staff to turn the patient slightly so that the weight of the patient is carried by a different part of the body. If the patient is severly incapacitated or particularly heavy this can be very hard work indeed, particularly as it needs to be done at frequent intervals, for example once every two hours, if bed sores are to be prevented. The present invention is broadly directed to providing a bed in which the patient can be supported by an open mesh net which helps to prevent the patient's skin becoming overheated and also assists in keeping its humidity low, both these factors assisting in reducing the tendency for bed sores to form. Also, by providing for this net support to be tiltable the patient can readily be rolled and moved far more easily than if the patient has to be lifted bodily on a stationary bed by the nursing staff.

According to the present invention there is provideda bed comprising a base frame, a support frame carried by the base frame for pivotal movement about an axis extending longitudinally thereof, and means for adjusting the pivotal position of the support frame relative to the base frame, the support frame comprising a pair of spaced parallel longitudinal members, a net extending across between said members, and means for varying the tensioning of the net at different locations along the length of the support frame.

In an earlier bed, disclosed in British patent specification No 1,447,163, using a net for the support of a patient the net has been slung in the form of a hammock between two roller members which could be rotated to move the net and thus roll or tilt the patient. However, this prior construction, because of its hammock-like arrangement, requires considerable structure to be provided above the normal bed level and also difficulties have arisen in use due to nursing staff having found it difficult to adjust the net properly to a particular patient. Thus the net needs to be tendioned to a greater or lesser extent depending upon which part of the patient's body it is supporting so as to adapt the shape of the patient's body and this is a difficult operation when the net is supported by being secured to roller members about which it is wound. With the present invention, however, individual adjusting means are provided at various spaced points lengthwise of the bed whereby the net can readily be mounted in position slung across the two longitudinal members and once the patient has been supported thereon the net tension can be adjusted very readily to accommodate to that particular patient. Additionally since the net, which is a relatively wide mesh net normally of nylon, tends to stretch and deform in use, required re-adjustment of the tensioning means can readily be carried out as and when required with the construction of the present invention.

Although tilting beds have been proposed in the past, for example a British patent specification No. 1,350,915, for movement about a longitudinal axis generally they have not been provided with a net variably tensionable as required by the present invention to provide the proper support of a patient for the alleviation and prevention of bed sores.

Preferably the means for varying the tensioning of the net comprises a plurality of screw adjusters placed lengthwise of the frame and these screw adjusters may conveniently be comprised of threaded screws of opposite hand for simultaneous adjustment of the tension at opposite sides of the net.

A particularly convenient way of mounting the screw adjusters to the net comprises the provision of a flexible elongate member, suitably a rod of fiber-glass reinforced plastics material, which engages, for example by being threaded through the mesh, the side edges of the net for engagement by the net tensioning means. Suitably the net tensioning means comprises hooks releasably engaging the rods and, in the preferred construction, the hooks are connected by an adjustable screw threaded connection to a cable leading to a nut threaded on the associated screw adjuster thereof.

Conveniently sockets can be provided on the support frame to receive the ends of the flexible rods. Whereas normally because of the flexibility of the rods and the lack of load from the patient at the ends of the beds a single socket for each rod will be sufficient, a plurality of sockets can be provided for each rod end to allow for additional adjustment of the rod location.

Conveniently the pivoting movement of the support frame relative to the base frame can be by means of a non-reversing drive such as a worm and worm wheel. With such an arrangement a single adjusting handle can be provided for releasable engagement with a drive on the worm and drives on the various tensioning means.

Preferably a displacement side wall, which may be padded, is pivotally mounted on each side of the base frame for movement between an upright position in which it helps to retain the patient on the bed when the support frame is tilted downwardly theretowards and a downward out-of-the-way position. In an alternative arrangement such a side wall may be mounted on the support frame so as to be able to support the patient for removal from the bed when the bed is fully tilted.

Preferably a head and back support is mounted to the support frame and comprises an inverted U-shaped frame carrying netting thereacross, the bight of the U-frame being pivotally and vertically adjustable at one end of the support frame and the ends of the legs of the U-frame being pivotally and vertically adjustable at one end of the support frame and the ends of the legs of the U-frame being shaped to be supported by said longitudinal members. By providing a net mesh on the head support a smooth comfortable transition can be provided to the patient from the head support to the main netting of the bed without the sharp ridge which could be expected using a conventional head support as normally provided on beds for the support of the head and upper body of the patient in a reclining or sitting up position.

The invention will be described, by way of example, with reference to the accompanying drawings, in which.

Figure 1:
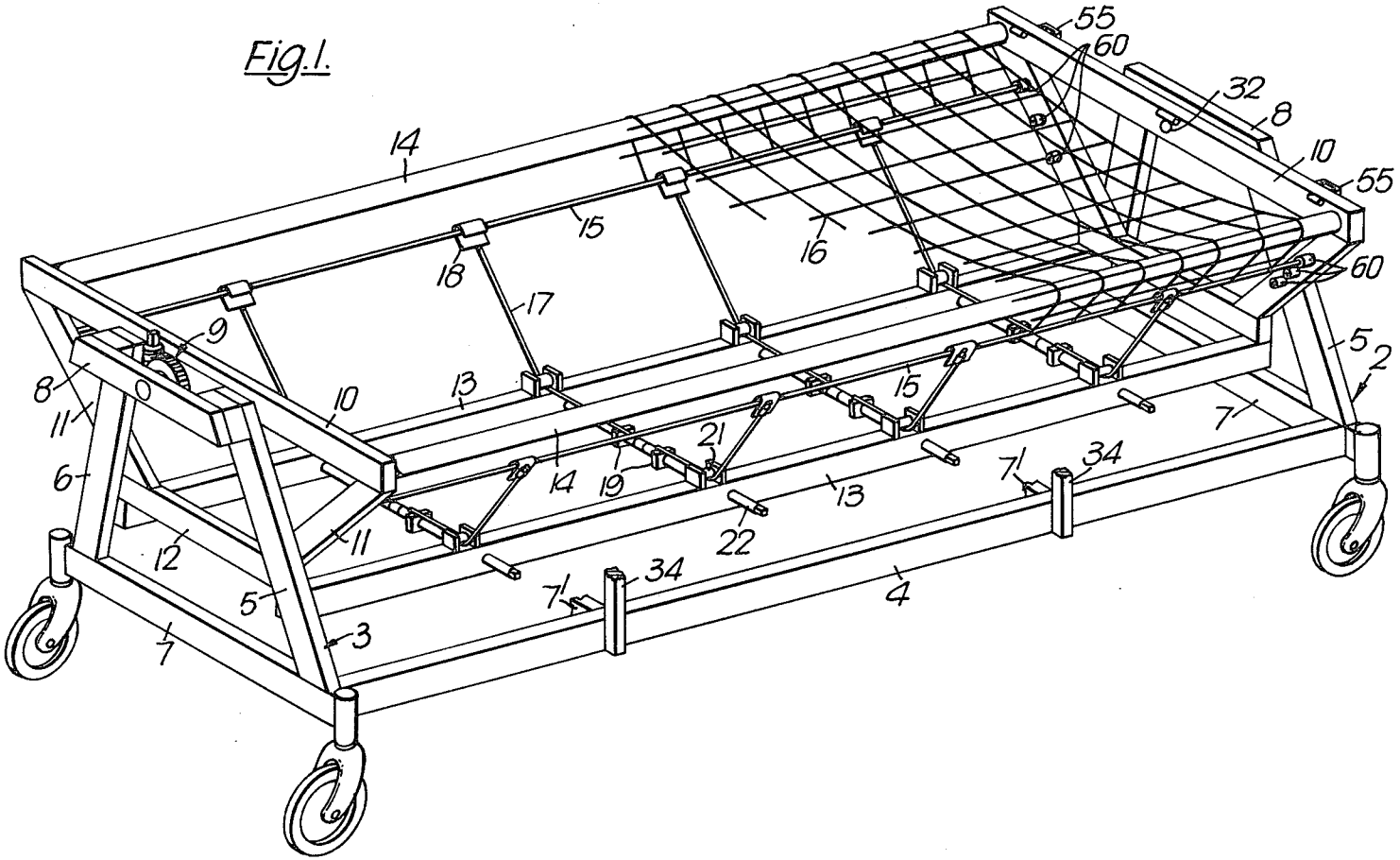
FIG. 1 is an isometric view, partly broken away, showing a bed embodying the present invention.

Referring to FIG. 1, a bed is illustrated which comprises a base frame comprised of two end frames 2 and 3 connected by a pair of parallel longitudinal members 4, only one of which is shown in the Figure. Two intermediate cross members join the two longitudinal members 4 and are shown, partly broken away, at 7' in FIG. 1. Each end frame comprises two inclined members 5 and 6 connected at the top and bottom by horizontal members 7 and 8. Conventional castoring wheels are provided to support the base frame.

A cradle-like support frame is supported for pivotal movement by the base frame about a longitudinal axis thereof. The support frame comprises two upper parallel longitudinally extending tubular rods 14 of cylindrical cross-section connected at each end to an upper frame member 10. The upper frame member 10 is connected by inclined box-section members 11 to a lower box-section member 12 and the box-section members 12 at each end of the support frame are connected by lower parallel longitudinal box-section members 13. The main frame at one end thereof is provided with a worm and worm wheel drive 9 mounted within a recess in the cross member 8. The worm wheel is connected for pivotal movement with the adjacent upper support frame member 10 whereby the support frame can be pivoted about its longitudinal axis by rotation of the worm.

An open mesh net 16, for example having a mesh size of about 5 cm., and conveniently of a nylon material is stretched across the two cylindrical cross-section longitudinal members 14 and tensioned thereacross by a plurality, herein illustrated as four, tensioning assemblies which engage flexible rods 15 of fiber-glass reinforced plastics material threaded into the mesh at the edges of the net.

Figure 2:
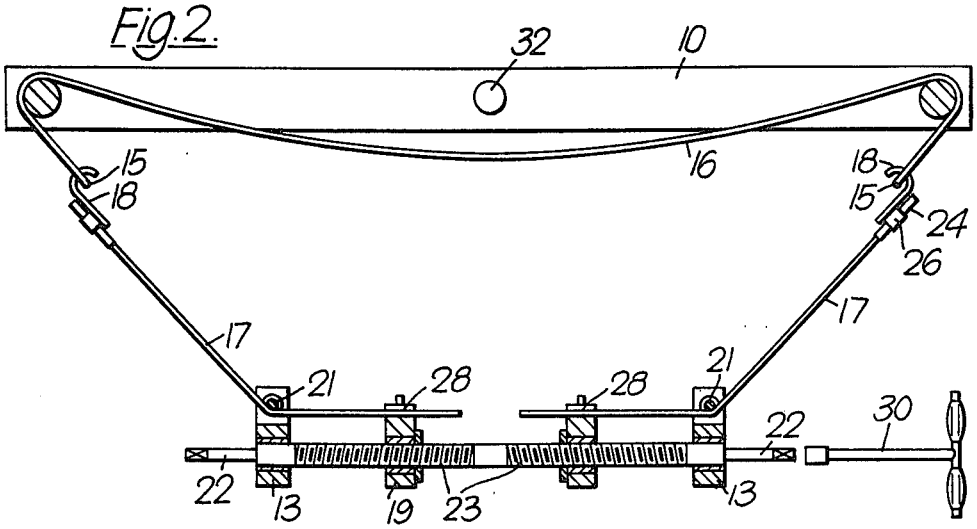
FIG. 2 is a diagrammatic end elevational view showing one tensioning assembly used in the bed of FIG. 1.

As can best be appreciated from FIG. 2 each tensioning assembly comprises a spindle 22 spanning the space between and supported by the two parallel box-section members 13. Threads 23 of opposite hand are provided on the spindle 22 and each is engaged by a nut 19 individual thereto. A cable 17 connects a hook 18 engaged with the rod 15 with the nut 19 to which it is clamped by a clamp 28. The cable 17 is trained beneath a guide 21 and is connected to the hook 18 by means of a threaded member 24 on the end thereof engaged by a nut secured to the hook 18. A removeable adjustment handle 30 is provided for engagement with a squared end of the spindle 22 and is also engageable with a similar squared end on the worm of the worm wheel gear adjustment 9. Normally, in use of the bed, the adjustment handle would be stored in place fitted on the worm to facilitate ready and prompt tiliting of the bed when required.

Figure 4:
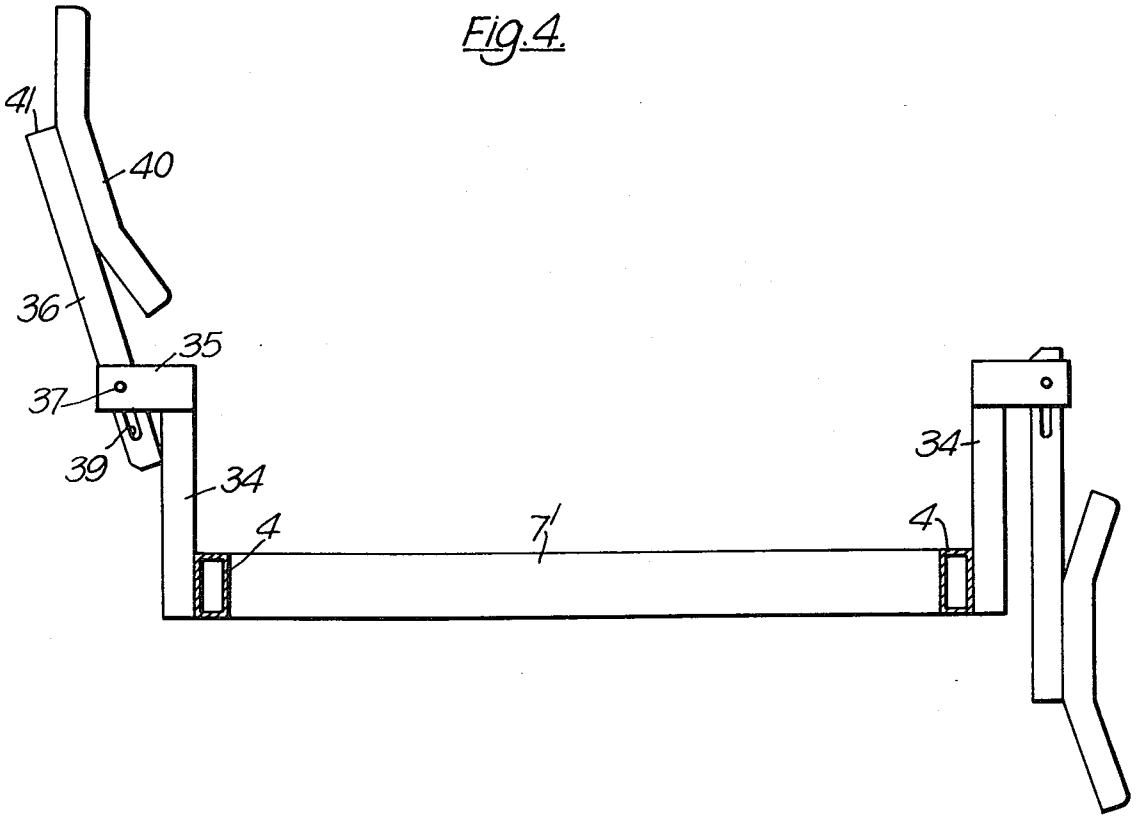
FIG. 4 is a diagrammatic cross-sectional view of a detail illustrating the manner in which side walls may be provided along the bed of FIG. 1.

The bottom portions of two uprights 34 are illustrated in FIG. 1 as mounted on the longitudinal member 4 of the base frame. As can be seen from FIG. 4 at the top end of each of the supports 34 is mounted a bracket 35. The bracket 35 comprises two arms spanned by a pin 37. The pin 37 passes through a slot 39 in a structural member 36 which supports a side wall 40. The side wall 40 extends the full length of the support frame and with the pin and slot connection 37 and 39 can alternatively be placed in an upright position as shown on the left of FIG. 4 in which it acts to retain a patient on the bed provided by the netting on the support frame and a downward out-of-the-way position as shown on the right of FIG. 4. Sockets 41 may be incorporated in the ends of the members 36 on the outside of the wall 40 for the mounting thereon of higher cot sides should these be required.

Figure 3:
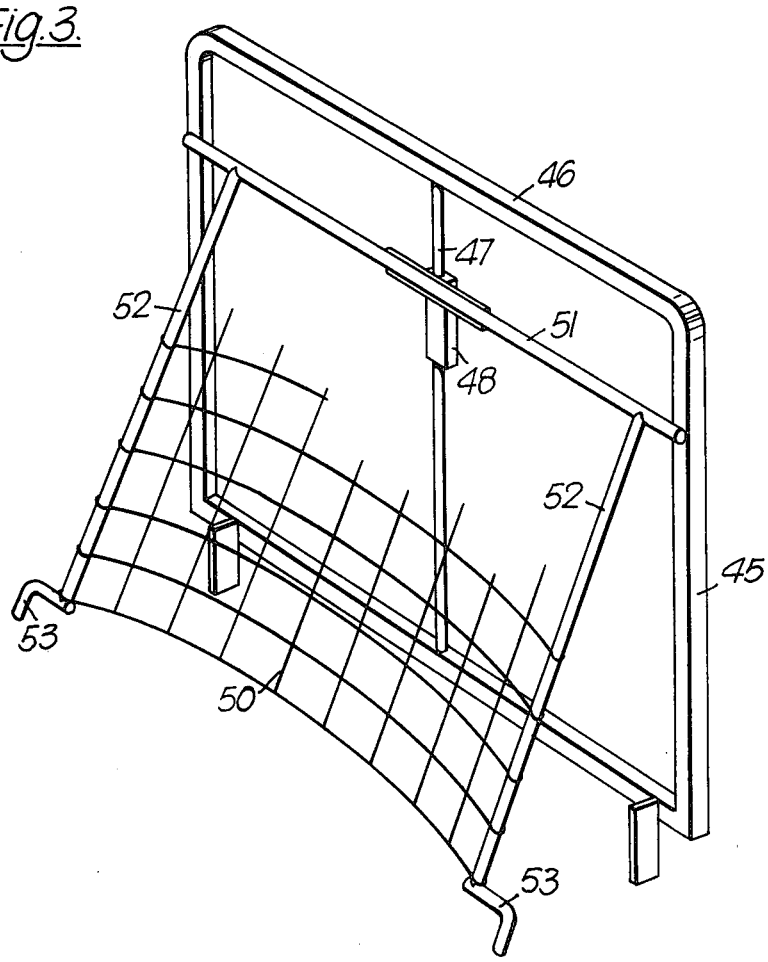
FIG. 3 is a diagrammatic perspective view of a back rest adapted for use with the bed of FIG. 1.

FIG. 3 illustrates a back and head rest specifically designed for use with the bed illustrated in FIG. 1. The back rest comprises a U-shaped frame member formed by a horizontal bight member 51 and two legs 52 extending therefrom and supporting a net 50 loosely spanning therebetween. The net can simply be mounted on the legs 52 by having the legs threaded through appropriate portions of the mesh of the net. Curved feet 53 at the lower ends of the legs 52 are provided for supporting engagement on the longitudinal members 14. The back rest is supported on a conventional back frame comprised by two upright members 45 connected by a horizontal member 46 and also supporting a vertical adjustment member 47. This back frame is received in conventional slotted brackets 55 mounted on the head end upper member 10 of the support frame. With the cross member 51 in its fully raised position the back support will be vertically positioned at the head end of the bed. However, by lowering the member 51 to engage the member 47 at various positions as determined by adjustment means 48 the back support can be inclined to the degree desired with the feet 53 supported by the longitudinal members 14 of the support frame.

In use of the bed the flexible rods 15 are threaded into the mesh at each side edge of the net spanning the members 14 and are engaged by the hooks 18 of the various tensioning devices. The spindles 22 are then rotated to cause the net to be tensioned across the members 14. When a patient is then placed on the bed the different tensioning devices can then individually be adjusted so that the net is suitably adjusted with different tensions at different portions of its length so as comfortably to take into account the shape of the patient so as to support the patient with the maximum degree of comfort. Normally an underblanket and a sheet would be provided on the netting before the patient is supported thereon.

In use of the bed over a period of time the netting will gradually stretch and change its shape but such changes can readily be counteracted simply by adjusting appropriate ones of the tensioning devices. If the limit of adjustment by the tensioning devices by rotation of the spindle 22 is reached further adjustment is possible by releasing the tension from the spindle 22, disengaging a hook 18 from the rod 15 and then rotating the hook on its mounting thread 24 at the end of the cable 17 so as effectively to change the length of the cable before replacing the hook on the rod 15 and retensioning using the rotation of the spindle 22.

Preferably, as illustrated, a socket 60 is provided on each of the inclined members 15 for receipt of one end of the flexible rod 15. While, because of the lack of loading at each end of the bed, a single such socket 60 is normally adequate, as illustrated, a plurality of such sockets may be provided aligned along the inclined member 11 whereby stretching or the use of slightly non-standard sized nets can be accommodated with slightly different positions for the rods 15. It will be appreciated that, if necessary, more permanent changes in length of the cables 17 can be accommodated by adjusting the position at which such cables are clampingly engaged by the clamps 28 on the nuts 19.

Once the patient is supported by the bed, movement of the patient on the bed can readily be caused simply by rotating the worm to change the inclination of the support frame so that the patient can readily be shifted so as to be supported by the net on a slightly different portion of his body.

While in the preferred, and illustrated, form of the bed the side walls 40 have been shown as being carried by the base frame it will be appriciated that in an alternative arrangement the side walls could be pivotally mounted to the support frame for relative movement therewith.

It may be appreciated that while it is of great importance that the bed should be tiltable about its horizontal axis 32 it is of vital importance that the net should be properly tensioned in use and this is greatly facilitated by the provision of a plurality of tensioning devices longitudinally of the net with the tension from each of these tensioning devices being smoothly spread to the net itself by the fact of the use of the flexible rod 15 which, as indicated, can be conveniently be made of a fiber-glass reinforced plastics material.

I claim:

1. In a bed comprising a base frame, a support frame carried by the base frame for pivotal movement about an axis extending longitudinally thereof, and means for adjusting the pivotal position of the support frame relative to the base frame, the support frame comprising a pair of spaced parallel longitudinal members, and a supporting web extending across between said members, the improvement that the web is a net and that a plurality of adjusting means are provided at separate locations intermediate the ends of the bed and spaced along the length of the support frame for providing a continuous adjustment to vary the tensioning of the net at different locations spaced along the length of the support frame.

2. A bed according to claim 1, wherein the adjusting means for varying the tensioning of the net comprise a plurality of screw adjusters spaced lengthwise of the frame.

3. A bed according to claim 2, wherein the screw adjusters each comprise a screw having screw threads of opposite hand at opposite ends thereof for simultaneous adjustment of the tension applied to opposite edges of the net by rotation of the screw.

4. A bed according to claims 1, 2 or 3, wherein a flexible elongate member engages the side edge of the net for engagement by the said separate adjusting means.

5. A bed according to claim 4, wherein the flexible elongate member comprises a rod of fiber-glass reinforced plastics material.

6. A bed according to claim 4, wherein the separate adjusting means comprise hooks releasably engaging the flexible elongate member.

7. A bed according to claim 6, wherein said separate adjusting means comprises an adjustable screw thread connector and a cable extending between each hook and connector associated therewith.

8. A bed according to claim 4, wherein sockets are provided on the support frame to receive ends of the flexible elongate member.

9. A bed according to claim 8, wherein a plurality of sockets are provided for each elongate member end.

10. A bed according to claim 4, wherein a worm and worm wheel are provided for pivoting the support frame relative to the base frame.

11. a bed according to claim 10, wherein a common replaceable adjustment handle is provided for adjusting the tensioning means and the worm.

12. A bed according to claim 1, wherein a displaceable side wall is pivotally mounted to each side of the base frame.

13. A bed according to claim 1, wherein a displaceable side wall is pivotally mounted on each side of the support frame.

14. A bed comprising a base frame, a support frame carried by the base frame for pivotal movement about an axis extending longitudinally thereof, means foe adjusting the pivotal position of the support frame relative to the base frame, the support frame comprising a pair of spaced parallel longitudinal members, and a supporting net extending across between said members, a plurality of adjusting means provided at separate locations spaced along the length of the support frame for varying the tensioning of the net at different locations spaced along the length of the support frame, and a head support mounted to the support frame and comprising an inverted U-shaped frame carrying netting thereacross, the bight of the U-shaped frame being pivotally and vertically adjustably mounted at one end of the support frame and the ends of the legs of the U-shaped frame being shaped to be supported by the longitudinal members at various inclinations of the head support.

15. In a bed comprising a base frame, a support frame carried by the base frame for pivotal movement about an axis extending longitudinally thereof, ands means for adjusting the pivotal position of the support frame relative to the base frame, the support frame comprising a pair of spaced parallel longitudinal members and a supporting web extending across between said members, the improvement that the web is a net having longitudinal sides edges and that the bed comprises a pair of flexible elongate members each engaging a respective one of said longitudinal side edges of the net, a plurality of screw adjusters provided at locations spaced lengthwise of the frame and means connecting said screw adjusters to the flexible elongate members at positions spaced longitudinally of the elongate members whereby the tension across the net is continuously variable at locations spaced lengthwise of the net by actuation of individual ones of said screw adjusters.

16. A bed according to claim 15, wherein said flexible elongate members each comprise a rod of fiber-glass reinforced plastics material.

17. A bed according to claim 15, wherein said means connecting the screw adjusters with the flexible elongate members comprise cables having ends provided with hooks releasably engaging the flexible elongate members.

18. A bed according to claim 17, wherein an adjustable screw thread connector is provided between each hook and its associated cable end.

19. A bed according to claim 15, wherein sockets are provided on a support frame and wherein said flexible elongate member has opposite ends received in said ones of the sockets provided on the support frame, a plurality of alternatively usable sockets being provided for each elongate member end.

* * * * *